US007637111B2

(12) United States Patent
Pieussergues et al.

(10) Patent No.: US 7,637,111 B2
(45) Date of Patent: Dec. 29, 2009

(54) EASILY DEMOUNTABLE COMBUSTION CHAMBER WITH IMPROVED AERODYNAMIC PERFORMANCE

(75) Inventors: Christophe Pieussergues, Nangis (FR); Pierre Pascal Sablayrolles, Paris (FR); Laurent Pierre Elysee Gaston Marnas, Vaux Le Penil (FR)

(73) Assignee: SNECMA, Paris (FR)

( * ) Notice: Subject to any disclaimer, the term of this patent is extended or adjusted under 35 U.S.C. 154(b) by 425 days.

(21) Appl. No.: 11/410,068

(22) Filed: Apr. 25, 2006

(65) Prior Publication Data

US 2006/0242939 A1 Nov. 2, 2006

(30) Foreign Application Priority Data

Apr. 28, 2005 (FR) ..... 05 04283

(51) Int. Cl.
*F02C 3/14* (2006.01)

(52) U.S. Cl. ..... 60/798; 60/804; 60/796

(58) Field of Classification Search ..... 60/804, 60/737, 748, 796, 797, 800, 752, 798
See application file for complete search history.

(56) References Cited

U.S. PATENT DOCUMENTS

| | | | | |
|---|---|---|---|---|
| 3,422,620 | A * | 1/1969 | Fantozzi et al. | 60/755 |
| 3,854,285 | A * | 12/1974 | Stenger et al. | 60/756 |
| 4,411,134 | A * | 10/1983 | Moir | 60/796 |
| 5,172,545 | A * | 12/1992 | Forestier | 60/800 |
| 5,353,587 | A * | 10/1994 | Halila | 60/756 |
| 6,282,886 | B1 * | 9/2001 | Sato et al. | 60/760 |
| 6,647,729 | B2 * | 11/2003 | Calvez et al. | 60/800 |
| 7,415,826 | B2 * | 8/2008 | McMasters et al. | 60/748 |
| 2005/0000228 | A1 * | 1/2005 | De Sousa et al. | 60/796 |

FOREIGN PATENT DOCUMENTS

FR 2.219.311 9/1974

OTHER PUBLICATIONS

U.S. Appl. No. 12/199,182, filed Aug. 27, 2008, Pieussergues, et al.

* cited by examiner

*Primary Examiner*—Ted Kim
(74) *Attorney, Agent, or Firm*—Oblon, Spivak, McClelland, Maier & Neustadt, L.L.P.

(57) ABSTRACT

The component elements of a jet engine combustion chamber are assembled together in a manner that is designed to facilitate maintenance while also improving aerodynamic performance. In an embodiment, the outer cap and the inner cap have tongues and the chamber end wall has corresponding tongues, and the tongues of the caps are assembled to the tongues of the chamber end wall.

14 Claims, 2 Drawing Sheets

20

EASILY DEMOUNTABLE COMBUSTION CHAMBER WITH IMPROVED AERODYNAMIC PERFORMANCE

This invention relates to a combustion chamber for a jet engine. It relates more particularly to an improvement in assembling the various portions of the combustion chamber, both in order to reduce disturbances to the flow of air around the chamber, which disturbances can be harmful to performance, and in order to facilitate maintenance of the chamber.

BACKGROUND OF THE INVENTION

A known combustion chamber is an assembly that can be divided into a plurality of portions. There is a generally annular outer wall, a generally annular inner wall, and a chamber end wall extending between said outer and inner walls. Fuel injector means are mounted on said chamber end wall. They are constituted by a plurality of injector systems that are spaced apart circularly. In addition, a fairing co-operates with the chamber end wall to define an annular cavity that houses the injector means. The combustion chamber as defined in this way constitutes an axially symmetrical assembly that needs to be as aerodynamic as possible since it is placed in the air stream. The fairing generally comprises an annular part referred to as the outer cap and an annular part referred to as the inner cap. The various component elements of the combustion chamber are assembled together in demountable manner. For example, it is known to assemble said outer and inner walls, said chamber end wall, and the fairing elements by means of a ring of bolts arranged in the vicinity of the chamber end wall. The heads of the bolts disturb the flow of air. This disturbance penalizes the performance of the combustion chamber.

In certain combustion chambers, assembly by bolting is replaced by a set of welds between said inner and outer walls, the chamber end wall, and the fairing. In that type of combustion chamber there are no longer any bolt heads for disturbing flow going round the outside or the inside of the combustion chamber. However, welding makes the combustion chamber difficult to repair since it is then necessary to cut said chamber along two circular welds. Since the welds are located on cones, it is very difficult and expensive to reassemble the combustion chamber after repairing an element thereof.

OBJECTS AND SUMMARY OF THE INVENTION

The invention makes it possible to overcome these two difficulties.

More precisely, the invention provides a jet engine combustion chamber comprising a generally annular outer wall, a generally annular inner wall, a chamber end wall extending between said outer and inner walls and having injector means mounted thereon, and a fairing co-operating with said chamber end wall to define an annular cavity that houses said injector means, said fairing comprising an annular part referred to as an "outer cap" and an annular part referred to as a "inner cap", wherein said caps include inner fastener parts projecting into said annular cavity, wherein said chamber end wall includes corresponding inner fastener parts projecting into said annular cavity, and wherein the fastener parts of said caps are assembled directly to the fastener parts of said chamber end wall.

The above-mentioned internal fastener parts may be tongues that are circumferentially distributed, or more generally they may be annular rims.

For example, if tongues are used, the tongues of said caps are welded to the tongues of said chamber end wall. They are preferably welded together in pairs at their ends only. Under such conditions, any disassembly of the component elements of the combustion chamber can be performed easily by grinding the ends of the tongues so as to eliminate the weld zones.

Having separate tongues makes it possible to subdivide the combustion chamber into a plurality of portions, thus enabling repairs to be made on any one of said portions.

If the fastener parts are annular rims, it is advantageous to conserve a sectorized configuration, as when using tongues, e.g. by making a plurality of welds that are regularly distributed circumferentially. It is possible to combine annular rims and tongues.

In an advantageous embodiment, said outer cap and said outer wall are assembled together circumferentially by welding. Welding may be butt welding.

Advantageously, the inner wall and the chamber end wall are secured to each other circumferentially. Assembly may be performed by riveting, or even by an interference fit.

The welding uniting the tongues is preferably welding of the conventional tungsten inert gas (TIG) type. A high current passes through a tungsten electrode to form an electric arc with the parts for assembling together. The metal receiving the arc is subjected to local melting. Welding is performed in an inert gas environment (e.g. an argon environment).

The tongues carried by the caps are preferably assembled thereto by brazing. Each tongue is assembled to the cap via a filler metal having a melting point that is lower than the melting points of the materials to be assembled together. Assembly is thus achieved without melting the metal of the parts for assembling together. Once raised to its melting temperature, the filler metal penetrates by capillary action between the portions for assembling together. The filler metal is preferably based on nickel so as to have a brazing temperature of about 1160° C.

According to another optional characteristic, the inner cap includes an annular margin in covering contact with the end portion of the inner wall.

BRIEF DESCRIPTION OF THE DRAWINGS

The invention can be better understood and other advantages thereof appear more clearly in the light of the following description given purely by way of example and made with reference to the accompanying drawings, in which.

MORE DETAILED DESCRIPTION

Figure 1:
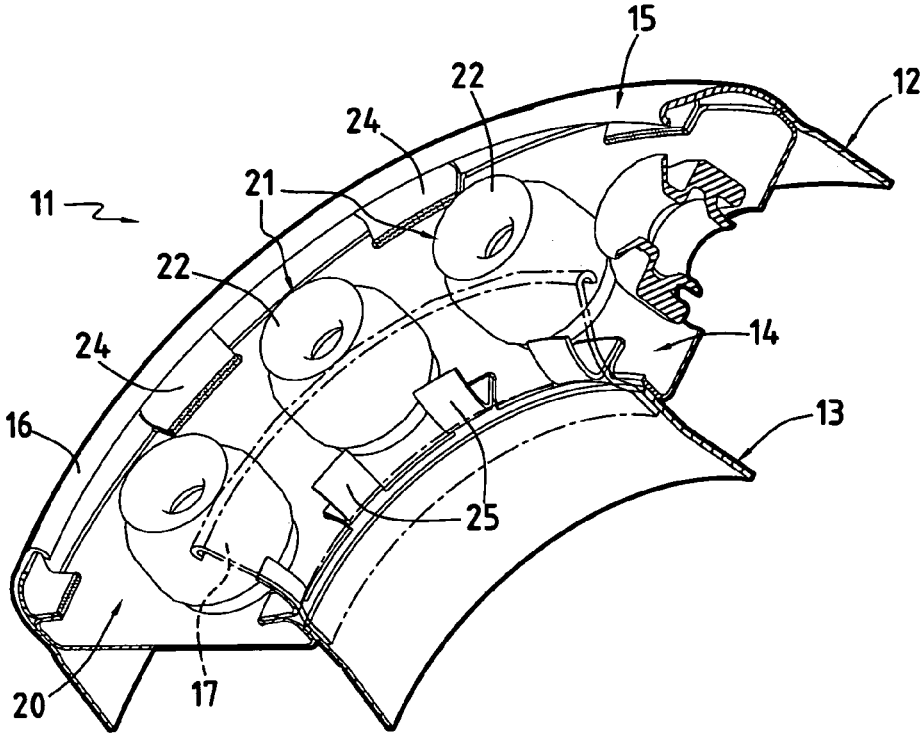
FIG. 1 is a fragmentary perspective view of a combustion chamber in accordance with the invention.

The drawings show a fragment of the front portion of a combustion chamber 11 that is made up by assembling together a plurality of annular parts. There can be seen a generally annular outer wall 12, a generally annular inner wall 13, a chamber end wall 14 extending between said outer and inner walls and having injector means 21 mounted thereon, and a fairing 15 comprising an annular part referred to as the "outer cap" 16 and an annular part referred to as the "inner cap" 17. The fairing co-operates with the chamber end wall to define an annular cavity 20 that houses the injector means. These means are constituted by a plurality of injectors 22 regularly spaced apart circumferentially and mounted on the chamber end wall 14.

The invention relates more particularly to the way in which said inner and outer walls, said chamber end wall, and the two caps are assembled together.

Figure 2:
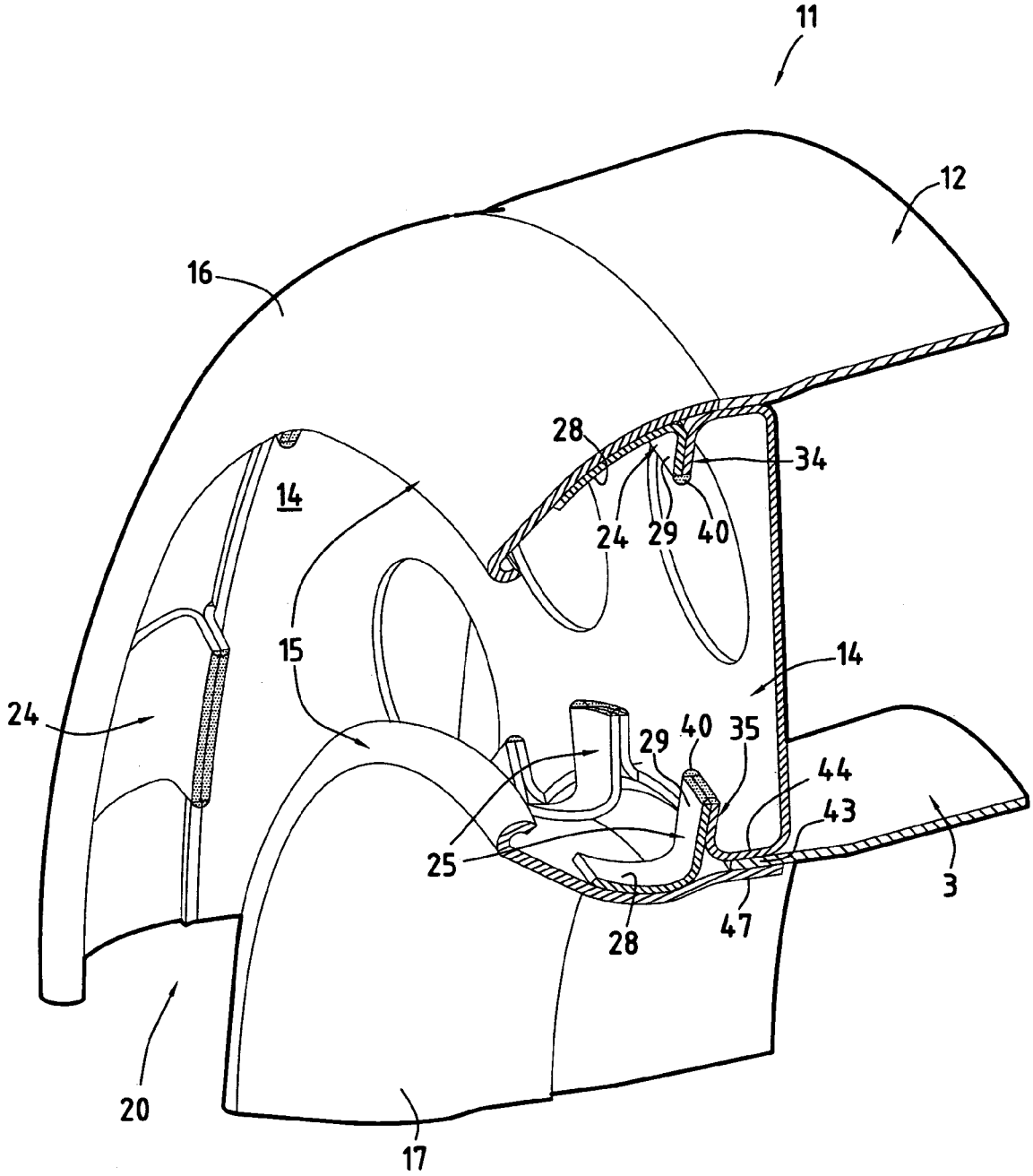
FIG. 2 is a view analogous to FIG. 1 in which the injector means have been removed in order to show more clearly how the various component portions of the combustion chamber are assembled together.

More particularly, the caps 16, 17 include respective tongues 24, 25 projecting into the annular cavity 20. These tongues are regularly spaced apart circumferentially. Each cap has as many tongues 24 or 25 as there are injectors, but they are offset circumferentially relative to the injectors so as to provide better accessibility during disassembly. A tongue 24 or 25 has a curved portion 28 matching the shape of the inside face of the cap, and a portion 29 bent radially inwards so as to project into the annular cavity. The chamber end wall also has tongues 34, 35 projecting into the annular cavity. The chamber end wall 14 and the tongues 34, 35 that it carries around its inner and outer peripheries are portions of a single metal sheet that has been cut and stamped as can be seen in FIG. 2. There can be seen a series of outer tongues 34 and a series of inner tongues 35. The outer tongues 34 of the chamber end wall and the tongues 24 of the outer cap are present in equal numbers and they coincide, with each tongue of the cap having its projecting portion pressed against the corresponding tongue of the chamber end wall. Similarly, the tongues 25 of the inner cap and the inner tongues 35 of the chamber end wall are in equal numbers and they coincide, with each tongue of the inner cap having its projecting portion pressed against the corresponding tongue of the chamber end wall. The tongues of said caps are assembled in these positions to the tongues of said chamber end wall. More particularly, the tongues of said caps and those of said chamber end wall are welded together in pairs, and preferably only at their ends. As mentioned above, the welding 40 is preferably of the TIG type. In contrast, the portions of the tongues 24, 25 that are secured to the caps 16, 17 are united therewith by brazing. Because the tongues are curved so as to touch each other in pairs one against the other, and because they are welded together at their ends only, it is relatively easy to separate them, e.g. by grinding said welded-together ends. Such grinding operations enable the various portions of the combustion chamber to be taken apart in order to perform repairs. After repairs have been performed, reassembly is possible by welding together the ends of the slightly shortened tongues 24, 35 and 25, 35.

Furthermore, the outer cap 16 and said outer wall 12 are assembled together circumferentially by welding. As shown, the welding 42 is butt welding, such that the flow of air outside the combustion chamber is not disturbed. The chamber end wall 14 is not secured to said outer part.

Furthermore, the inner wall 13 and said chamber end wall 14 are united circumferentially. In the embodiment described, these two walls are shaped to have touching annular margins 43 and 44. These margins may be united by riveting or by interference fit. Said inner cap 17 also has an annular margin 47 in covering contact with the annular margin of said inner wall. It is not secured to said inner wall. This arrangement leads to very little disturbance of the air flow inside the passage defined by the inner wall and the inner cap of the combustion chamber. Said inner wall 13 and said inner cap 17 are not united in their zone of contact.

Figure 3:
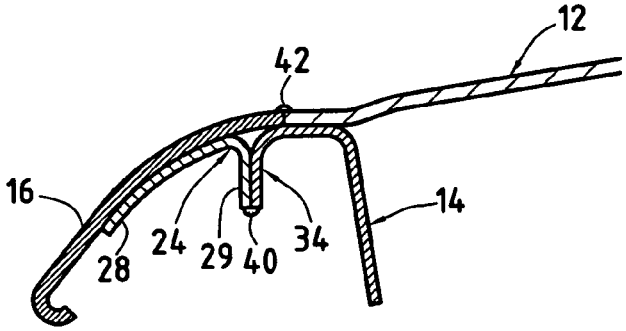
FIG. 3 is a radial section on a scale larger than FIG. 2.
Figure 3:
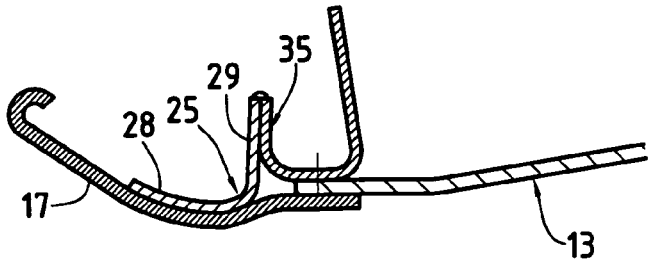

In section, an assembly making use of annular rims would have the same configuration as shown in FIG. 3.

What is claimed is:

1. A jet engine combustion chamber comprising a generally annular outer wall, a generally annular inner wall, a chamber end wall extending between said outer and inner walls and having injector means mounted thereon, and a fairing co-operating with said chamber end wall to define an annular cavity that houses said injector means, said fairing comprising an annular part referred to as an "outer cap" and an annular part referred to as a "inner cap", wherein inner fastener parts projecting into said annular cavity are fixed to said caps, wherein said chamber end wall includes corresponding inner fastener parts projecting into said annular cavity, and wherein the fastener parts of said caps are assembled directly to the fastener parts of said chamber end wall, wherein said fastener parts are tongues that are distributed circumferentially, and wherein said injector means comprises a plurality of injectors, and wherein each cap has as many tongues as there are injectors, said tongues being offset circumferentially relative to the injectors.

2. A combustion chamber according to claim 1, wherein the tongues of said caps and the tongues of said chamber end wall are welded together.

3. A combustion chamber according to claim 1, wherein both said tongues of said caps, and said tongues of said chamber end wall are curved in such a manner as to extend side by side in pairs one against the other, and wherein they are welded together in pairs at their ends.

4. A combustion chamber according to claim 1, wherein said inner fastener parts are annular rims.

5. A combustion chamber according to claim 1, wherein said outer cap and said outer wall are assembled together circumferentially by welding.

6. A combustion chamber according to claim 5, wherein said outer cap and said outer wall are butt welded together.

7. A combustion chamber according to claim 1, wherein said inner wall and said chamber end wall are united circumferentially.

8. A combustion chamber according to claim 7, wherein said inner wall and said chamber end wall are shaped with contacting annular margins that are untied by riveting or by an interference fit.

9. A combustion chamber according to claim 8, wherein said inner cap includes an annular margin in covering contact with said annular margin of said inner wall.

10. A combustion chamber according to claim 1, wherein said chamber end wall and the inner fastener parts carried thereby are portions of a single sheet of metal that has been cut and stamped.

11. A combustion chamber according to claim 1, wherein the tongues carried by said caps are assembled thereto by brazing.

12. A combustion chamber according to claim 1, wherein said chamber end wall is not secured to said outer cap.

13. A combustion chamber according to claim 12, wherein said inner wall and said inner cap are not united in their zone of contact.

14. A combustion chamber according to claim 1, wherein both said tongues of said caps, and said tongues of said chamber end wall are assembled together in pairs by a weld at their ends only so as to be separable from each other by a removal of said weld at their ends.

* * * * *